US005698287A

United States Patent [19]

Neiman

[11] Patent Number: 5,698,287

[45] Date of Patent: Dec. 16, 1997

[54] MEDALLION WITH DECORATED SUBSTRATE CARRIED THEREON

[76] Inventor: Conrad V. Neiman, 115 Franklin St., Brevard, N.C. 28712

[21] Appl. No.: 591,968

[22] Filed: Jan. 29, 1996

Related U.S. Application Data

[60] Provisional application No. 60/007, 934, Dec. 4, 1995.

[51] Int. Cl. [6] ..... A44C 21/00

[52] U.S. Cl. ..... 428/66.5; 156/89; 156/293; 428/67

[58] Field of Search ..... 428/64.1, 66.5, 428/67; 156/89, 293

[56] References Cited

U.S. PATENT DOCUMENTS

| | | | |
|---|---|---|---|
| 2,001,725 | 5/1935 | Harris | 428/67 |
| 2,237,152 | 4/1941 | Larmour | 156/303.1 |
| 2,358,720 | 9/1944 | Larmour | 428/67 |
| 2,722,496 | 11/1955 | Hosmer | 428/64.1 X |
| 2,993,815 | 7/1961 | Treptow | 428/209 |
| 3,629,042 | 12/1971 | Cranfill | 156/298 X |
| 3,953,932 | 5/1976 | Graves | 428/66.5 X |
| 4,073,671 | 2/1978 | Licata | 156/298 X |
| 4,190,691 | 2/1980 | Kramer | 428/67 |
| 4,263,734 | 4/1981 | Bradshaw | 428/67 X |
| 4,277,528 | 7/1981 | Doi et al. | 428/80 X |
| 4,301,213 | 11/1981 | Davies | 428/429 |
| 4,465,740 | 8/1984 | Diamond et al. | 428/542.2 |
| 4,472,891 | 9/1984 | Ielpo | 428/64.1 X |
| 5,458,930 | 10/1995 | Brown | 156/293 X |

*Primary Examiner*—Henry F. Epstein
*Attorney, Agent, or Firm*—Michael A. Mann

[57] ABSTRACT

An article comprising a medallic artwork with an embedded, decorated substrate, such as a ceramic wafer, carrying a miniaturized reproduction of two-dimensional artwork. Preferably, the two-dimensional artwork is reproduced in the form of a four-color decal that is fired onto a porcelain wafer. The medallic artwork is formed by striking, hot or cold casting, molding, or by the lost wax method and includes a depression dimensioned for receiving the wafer. The medallic artwork protects and enhances the two-dimensional artwork, and its design preferably corresponds to the artwork to create a unique, collectable work of art in and of itself.

10 Claims, 1 Drawing Sheet

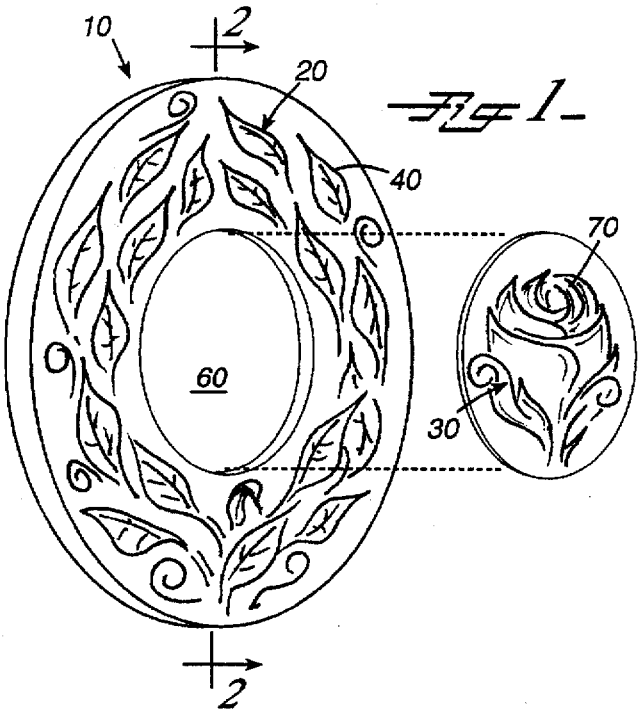
Fig 1
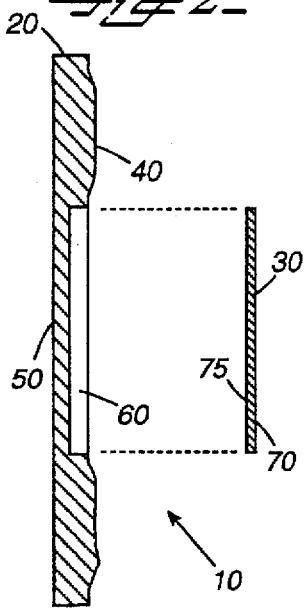
Fig 2
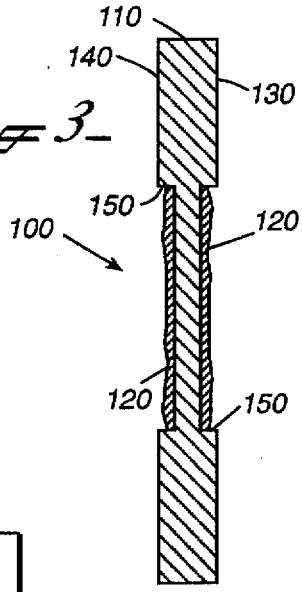
Fig 3
Fig 4
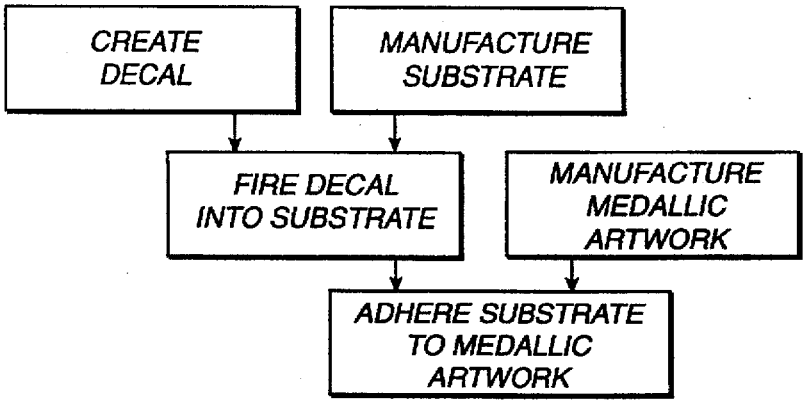

MEDALLION WITH DECORATED SUBSTRATE CARRIED THEREON

This application claims the benefit of U.S. Provisional Application No. 60/007,934 filed Dec. 4, 1995.

BACKGROUND OF THE INVENTION

1. Field of the Invention

The present invention relates generally to commemorative coins and medallions. More specifically, the present invention relates to embedding commemorative coins and medallions with substrates for various purposes.

2. Discussion of Background

Non-monetary coins and medallions are made for a variety of purposes, including commemorating events or special occasions. These items are examples of medallic art, which are decorations worked in relief; that is, the images on them are formed by removing or redistributing a small amount of material, leaving a three-dimensional, contoured surface.

The subjects for medallic art can sometimes be taken from two-dimensional, full color artwork. Translating the two-dimensional, colorful artwork to either high or low relief in metal is in itself an art. Furthermore, the commemorative coin or medallion is usually smaller than the original two-dimensional work. The difference in medium and in size inevitably means a loss of detail and color. Inevitably, the artists are not pleased with the result, regardless of the skill of the sculptor.

There is a technique for making a replica of two-dimensional, full color artwork in the form of a decal that can be fired onto a porcelain surface. This technique has been used to decorate coffee mugs and files.

Although it is also known to apply porcelain to metal, heretofore, combining this decal-based technique with medallic art has not been known.

SUMMARY OF THE INVENTION

According to its major aspects and briefly stated, the present invention is the embedding of a porcelain wafer, carrying a full-color, miniature reproduction of two-dimensional artwork, onto an anaglyph medallic piece of art, such as a commemorative coin or medallion. The medallic art is formed by striking, molding, cold casting, hot casting, or by the well known "lost wax" method. The artwork is applied to the porcelain wafer by creating a decal that is a four-color, miniature version of the full-sized, two-dimensional artwork and then firing the decal onto the surface of the wafer. The medallic art's design preferably corresponds to the reproduction in its ornamentation and text, and embedding protects the wafer.

The use of four-color reproduction, in miniature, is an important feature of the present invention, because the resulting commemorative coin or medallion will contain a much more acceptable likeness of the original art.

The medallic art with a depression formed therein for embedding the ceramic wafer is another important feature of the present invention. The medallic art not only can complement the artwork, but it can also protect it.

The embedding of a miniature reproduction of art in a commemorative coin or medallion is another feature of the present invention because it adds color and detail to the article.

The use of the technique of firing a decal onto porcelain in combination with the commemorative coin or medallion is still another feature of the present invention. This technique allows all of the color and detail to be reproduced, even in miniature, and does so in a way that will last with minimal fading.

Other features and advantages will be apparent to those skilled in the art from a careful reading of the detailed description of a preferred embodiment accompanied by the following drawings.

BRIEF DESCRIPTION OF THE DRAWINGS

In the drawings,

FIG. 1 is an exploded, perspective view of an article according to a preferred embodiment of the present invention;

FIG. 2 is an exploded, cross sectional side view of an article according to a preferred embodiment of the present invention;

FIG. 3 is a cross sectional side view of an article according to an alternative preferred embodiment of the present invention; and FIG. 4 is a flow chart depicting a method for forming an article according to a preferred embodiment of the present invention.

DETAILED DESCRIPTION OF A PREFERRED EMBODIMENT

In its preferred embodiment, the present invention is the embedding of a four-color, miniature reproduction of two-dimensional artwork carried by a ceramic substrate into a commemorative coin or medallion. Clearly, if the original art is small enough, it may not have to be reduced in size. Furthermore, if the original art is a pen and ink drawing, having no color, the present technique will nonetheless still apply. Finally, it will be clear that, rather than using a ceramic wafer to carry the artwork, a small glass or transparent plastic wafer can be placed over artwork that has been placed in a depression formed in the medallic art.

Reference is now made to FIGS. 1 and 2, which show an exploded perspective view and a cross sectional side view of the article, respectively, generally indicated by reference numeral 10. Article 10 comprises a medallic artwork 20 in the form of a coin or medallion and a substrate 30.

Medallic artwork 20 has a front face 40 and a rear face 50 which can be contoured to create any decorative appearance desired by an artist. Formed along front face 40 of medallic artwork 20 is a recess or depression 60, dimensioned to receive substrate 30. Preferably, substrate 30 is also thinner than depression 60 is deep. The shape of surface of depression 60 preferably corresponds to the shape of substrate 30—if substrate 30 is convex, then depression 60 should be convex, for example—and most preferably, depression 60 is smooth and flat. Medallic artwork 20 can be made of any metal or metal alloy which has the requisite strength and malleability required of the particular application. Examples of suitable materials for medallic artwork are gold, gold alloys, silver, copper, bronze, aluminum, and pewter. Also, it will be appreciated that although illustrated in the figures as a disk, medallic artwork 20 may be formed to assume any desired shape.

Preferably, substrate 30 is made of any sintered ceramic material on which an art reproduction can be applied. Most preferably, given considerations of cost, durability and aesthetic characteristics, substrate 30 is vitrified porcelain. Substrate 30 is vitrified in accordance with well-known ceramic processing procedure. Front face 70 of substrate 30 has fired thereon a miniaturized reproduction of a two-dimensional art work. The method used to impart the replica of art onto front face 70 of substrate 30 may be any method commonly employed by those skilled in the ceramic arts that is capable of accurate reproduction in four-color art. Most preferably, the method is one that lends itself to exact, repeatable reproduction rather than, for example, hand painting, which is inexact and not accurately repeatable.

For illustrative purposes, a method for replicating a two-dimensional piece of art onto substrate 30 may be as follows: A two-dimensional artwork, such as a painting, is scanned into a laser scanner having high color resolution. The scanner is in operational connection with a printer equipped to print the scanned image onto decal paper suitable for application to ceramics. This decal paper is impregnated with a glue or adhesive to prevent the migration of pigments imprinted by the printer. The imprinted decal is then covered with clear lacquer and allowed to dry. Thereafter, the lacquered decal is submerged in water, which serves to separate the paper from the lacquered pigment. The lacquered pigment is then placed over front face 70 of substrate 30 and fired. This method serves to produce four-color, high-resolution, miniaturized reproductions of two-dimensional art work onto substrate 30.

Substrate 30 is adhered to medallic artwork 20 by placing a layer of adhesive onto rear face 75 of substrate 30 and thereafter placing substrate 30 within depression 60. The type of adhesive used will depend upon the choice of materials for medallic artwork 20 and substrate 30 and is within the purview of an artisan with ordinary skill in the art; however, silica-based adhesives are preferred.

Turning now to FIG. 3, there is shown a cross sectional side view of an alternative embodiment of the present invention, generally designated by reference numeral 100. Article 100 comprises an medallic artwork 110 and two substrates 120. Formed in first face 130 and second face 140 of medallic artwork 110 are recesses 150 dimensioned to receive substrates 120.

Turning now to FIG. 4, there is shown a flow chart depicting a method for forming an article according to a preferred embodiment of the present invention. The method first involves creating a decal from a two-dimensional artwork. This can be accomplished by using any known technique able to replicate the art in a four-color printing. Thereafter, a sintered substrate is manufactured. The decal of the artwork is then fired into the substrate using standard ceramic glazing procedures. Meanwhile, the anaglyph medallic artwork is manufactured with a low or high relief, sculpted surface and a recess for receipt of the substrate. The manufacture of the medallic artwork may be done manually or in accordance with procedures known to the art of metal working. Such procedures include, but are not limited to, striking, cold casting, hot casting, molding, and the lost wax method. The decorated substrate is then attached within the depression in the medallic artwork using a suitable adhesive.

The foregoing article and method serves to produce a collectable piece having a sculpted surface carrying thereon a miniaturized replica of a two-dimensional artwork. The article can be manufactured with any design in any format desired by the artist. Such formats include, but are not limited to, medallions and commemorative coins. Preferably, the design on the medallic artwork is made to correspond to the artwork. For example, if the artwork is of wildlife, the medallic artwork may include text and artwork that identify the wildlife and depict flora characteristic of the wildlife habitat, or it could repeat in three dimensions a portion of the two-dimensional art.

It will be apparent to those skilled in the art that many modifications and substitutions can be made to the preferred embodiment just described without departing from the spirit and scope of the invention as defined in the appended claims.

What is claimed is:

1. An article made by a method comprising the steps of:

replicating a two dimensional artwork onto a first substrate;

forming a medallion, said medallion having a front face and a rear face, said medallion having a recess dimensioned to receive said substrate; and adhering said substrate to said medallion within said recess.

2. The article as recited in claim 1, wherein said first substrate is vitrified porcelain.

3. The article as recited in claim 1, wherein said the step of adhering further comprises applying a silica-based adhesive to said medallion within said recess.

4. The article as recited in claim 1, wherein said medallion is made of a material selected from the group consisting of gold, gold alloys, silver, copper, bronze, aluminum and pewter.

5. The article as recited in claim 1, wherein said forming step is achieved by a method selected from the group consisting of striking, cold casting, hot casting, molding, and using the lost wax method.

6. The article as recited in claim 1, wherein said substrate is a sintered ceramic, and said replicating step further comprises the steps of:

creating a decal of said two dimensional artwork; and firing said decal into said substrate.

7. A method for making an article, said method comprising the steps of:

replicating a two dimensional artwork onto a substrate;

forming a medallion, said medallion being contoured, said medallion having a recess dimensioned to receive said substrate; and adhering said substrate to said medallion within said recess.

8. The method as recited in claim 7, wherein said forming step is achieved by a method selected from the group consisting of striking, cold casting, hot casting, molding, and using the lost wax method.

9. The method as recited in claim 7, wherein said substrate is a sintered ceramic.

10. The method as recited in claim 7, wherein said substrate is a sintered ceramic, and said replicating step further comprises the steps of:

creating a decal of said two dimensional artwork; and firing said decal into said substrate.

* * * * *